US011414981B2

(12) United States Patent
Breaux

(10) Patent No.: US 11,414,981 B2
(45) Date of Patent: Aug. 16, 2022

(54) INTEGRATED GAMMA SENSOR CONTAINER

(71) Applicant: HALLIBURTON ENERGY SERVICES, INC., Houston, TX (US)

(72) Inventor: Brian David Breaux, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 176 days.

(21) Appl. No.: 16/645,464

(22) PCT Filed: Jun. 30, 2019

(86) PCT No.: PCT/US2019/040031
§ 371 (c)(1),
(2) Date: Mar. 7, 2020

(87) PCT Pub. No.: WO2021/002828
PCT Pub. Date: Jan. 7, 2021

(65) Prior Publication Data

US 2021/0404322 A1 Dec. 30, 2021

(51) Int. Cl.
*E21B 47/017* (2012.01)

(52) U.S. Cl.
CPC ..... *E21B 47/017* (2020.05)

(58) Field of Classification Search
CPC ..... E21B 47/017; G01T 1/20; G01T 1/167; G01T 1/169
See application file for complete search history.

(56) References Cited

U.S. PATENT DOCUMENTS

| | | | | |
|---|---|---|---|---|
| 6,134,892 | A * | 10/2000 | Turner | F25B 21/02 62/3.2 |
| 7,507,969 | B1 * | 3/2009 | Jones | G01T 1/167 250/361 R |
| 8,286,475 | B2 * | 10/2012 | Nakajima | E21B 47/017 73/152.51 |
| 8,922,988 | B2 * | 12/2014 | Swett | H05K 5/0213 361/679.36 |
| 9,097,100 | B2 | 8/2015 | Finke et al. | |
| 9,879,520 | B2 * | 1/2018 | Fanini | E21B 47/017 |
| 2009/0014166 | A1 * | 1/2009 | Cheeseborough | G01V 11/002 166/65.1 |
| 2012/0324993 | A1 | 12/2012 | Nakajima et al. | |
| 2014/0312752 | A1 * | 10/2014 | Durisotti | E21B 47/017 312/237 |

(Continued)

OTHER PUBLICATIONS

International Written Opinion, PCT Application No. PCT/US2019/040031, dated Apr. 24, 2020.

(Continued)

*Primary Examiner* — Nicole Coy
(74) *Attorney, Agent, or Firm* — Polsinelli PC

(57) ABSTRACT

Aspects of the subject technology relate to a sensor container for a downhole tool. The sensor container can be mountable in a receiver space on a carrier that is insertable into a wellbore. The sensor container can comprise a container body having a receiving space to which a shock-sensitive sensor is couplable. Further, the sensor container can comprise a shock absorber positioned at a lateral side thereof. The shock absorber can be configured to buffer shock forces and vibration forces acting thereupon.

18 Claims, 8 Drawing Sheets

(56) References Cited

U.S. PATENT DOCUMENTS

| | | | | |
|---|---|---|---|---|
| 2015/0097112 | A1 | 4/2015 | Sinclair et al. | |
| 2015/0252666 | A1 | 9/2015 | Wang et al. | |
| 2015/0330208 | A1 | 11/2015 | Haubold et al. | |
| 2017/0184731 | A1 | 6/2017 | Deere et al. | |
| 2017/0275984 | A1 | 9/2017 | Wang et al. | |
| 2019/0094392 | A1* | 3/2019 | Dinica | G01T 1/208 |
| 2020/0370415 | A1* | 11/2020 | Das | E21B 47/017 |
| 2020/0370422 | A1* | 11/2020 | Finke | E21B 47/01 |

OTHER PUBLICATIONS

International Search Report and Written Opinion for PCT Application No. PCT/US2019/040031, dated Apr. 24, 2020, 12 pages.

* cited by examiner

INTEGRATED GAMMA SENSOR CONTAINER

CROSS-REFERENCE TO RELATED APPLICATIONS

This application is a national stage entry of PCT/US2019/040031 filed Jun. 30, 2019, said application is expressly incorporated herein in its entirety.

TECHNICAL FIELD

The present technology pertains to assemblies for housing components, and more particularly, to assemblies for use on a downhole tool in a drilling environment.

BACKGROUND

In the exploration and production of hydrocarbons, various downhole tools are frequently lowered into a borehole, such as drilling assemblies, measurement tools, and production devices. Such downhole tools often include a number of components such as electronic equipment, sensors, or other modules used for various purposes. For example, the components may be used for controlling the downhole tools, communicating with a surface location, and storage and analysis of monitored wellbore data. These components may include sensitive parts including, for example, sensors/detectors, printed circuit boards (PCBs), and electronics that are mounted to the PCBs. The downhole tools and/or components to be secured to the downhole tools are shipped to the field, handled, and installed for use in a wellbore. The downhole tool may be pre-loaded, thereby subjecting the components to elevated mechanical stress and strain. Further, the downhole tool may experience harsh downhole environments including, for example, elevated temperatures and pressures, vibration, thermo-mechanical stresses, and thermal shock.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1A:
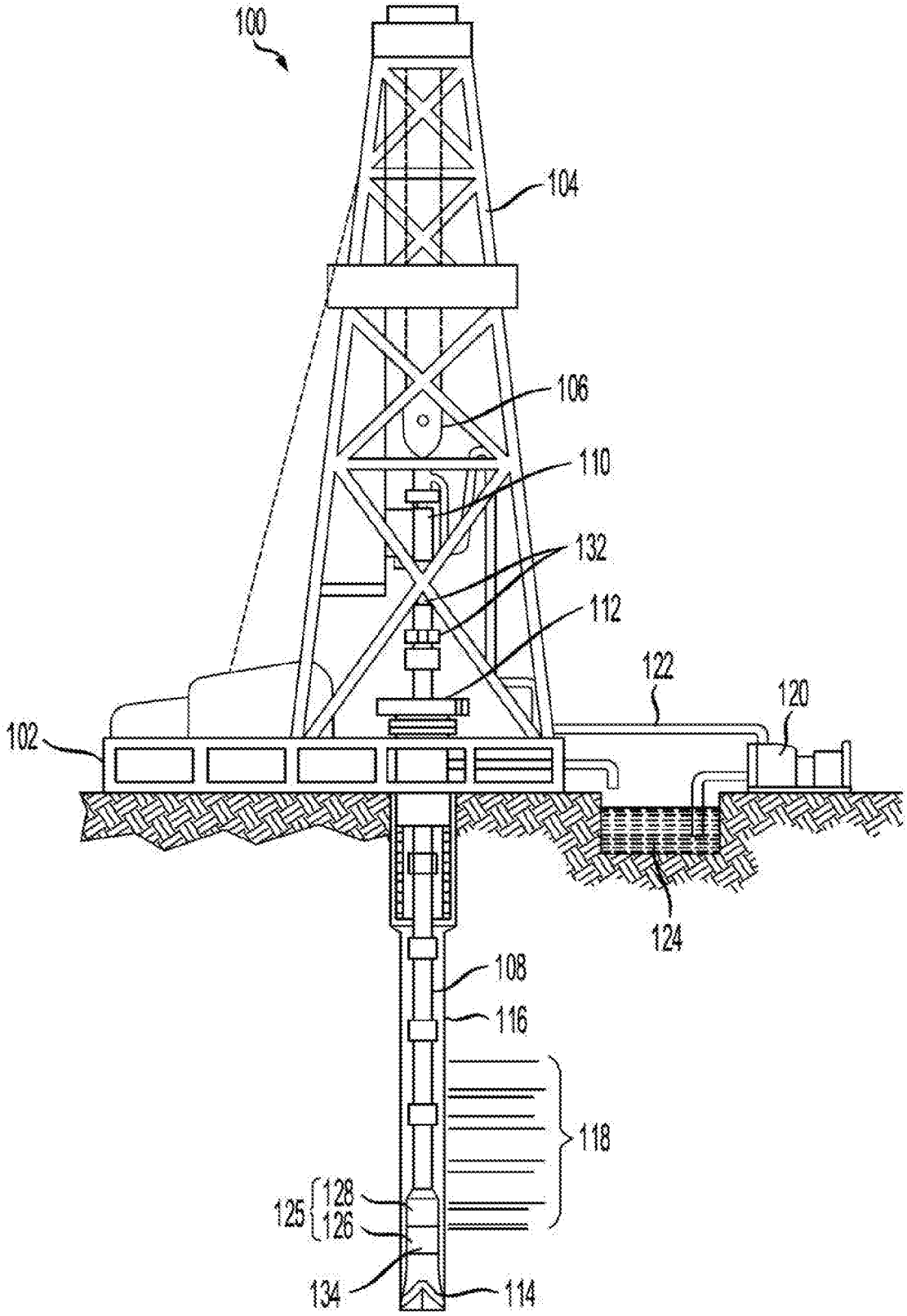
FIG. 1A is a schematic diagram of an example logging while drilling (LWD) wellbore operating environment, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Exploration and production of hydrocarbons generally involves the use of various tools that are lowered into or used to create a borehole, such as drilling assemblies, measurement tools, or production devices. Various components may be disposed downhole for various purposes, such as control of downhole tools, communication with the surface and storage and analysis of data. The components may include, for example, electronic components, sensors, power supplies, batteries and the like. Many of these components are sensitive or include sensitive parts. However, the downhole environments are quite harsh and may include extreme temperatures, pressures, vibrations, and/or other thermo-mechanical stresses. Even prior to being installed in a downhole tool for use, transporting the components and the downhole tool to remote field locations can involve difficult conditions that impose additional stresses.

Aspects of the subject technology relate to a sensor container for housing electronics, detectors, and sensors within a downhole tool that protects the electronics, detectors, and sensors from the harsh environments that may be experienced. Disclosed are systems, assemblies, and methods for housing electronics, detectors, and sensors used on a downhole tool in a drilling environment.

In various embodiments, a sensor container for a downhole sensor is provided. The sensor container can be mounted in a receiving space on a carrier that is insertable into a wellbore. The sensor container can comprise a container body having a receiving space to which a shock-sensitive sensor is couplable. Further, the sensor container can comprise a shock absorber positioned at a lateral side thereof. The shock absorber can be configured to buffer shock forces and vibration forces acting thereupon.

In various embodiments, a downhole tool is provided. The downhole tool can comprise a drilling assembly. The downhole tool can also comprise a sensor container mounted in a receiving space of a carrier portion of the downhole tool. The sensor container can comprise a container body having a receiving space in which a shock-sensitive sensor is coupled. Further, the sensor container can comprise a shock absorber positioned at a lateral side of the sensor container. The shock absorber can be configured to buffer shock forces and vibration forces that act thereupon.

In various embodiments, a method for fabricating a sensor container for a downhole tool is provided. The method can include identifying characteristics of the downhole tool and characteristics of a shock-sensitive sensor configured to gather environmental measurements of the downhole tool during operation of the downhole tool. The method can also include fabricating a container body of the sensor container based on the characteristics of the shock-sensitive sensor and the characteristics of the downhole tool. The container body can have a receiving space to which the shock-sensitive sensor is couplable. Further, the method can include fabricating a shock absorber of the sensor container based on the characteristics of the shock-sensitive sensor and the characteristics of the downhole tool. The shock absorber can be positionable at a lateral side of the container body. Further, the shock absorber can be configured to buffer shock forces and vibration forces acting thereupon.

These and other features of the sensor container solve various technical problems and provide various advantages over other approaches. For example, various aspects of the subject technology can buffer applied forces, e.g. shock forces and vibration forces on a sensor container, and subsequently a contained sensor, in response to ambient downhole shock and vibration occurring during operation of the downhole tool. Buffering, as used herein, can include absorbing all or a portion of one or more forces applied to a downhole tool and subsequently a sensor container integrated within the downhole tool. In turn, buffering forces applied to a sensor container in response to ambient downhole shock and vibration occurring during operation of the downhole tool can improve the overall quality of measurements taken by a sensor contained within the sensor container. For example, external vibrations can degrade gamma measurements made by a gamma sensor of the downhole tool. Therefore, buffering forces applied to a sensor container containing the gamma sensor from the external vibrations can facilitate the gathering of more accurate and higher quality measurements by the gamma sensor. Further, buffering forces applied to a sensor container and a sensor in response to ambient downhole shock and vibration occurring during operation of the downhole tool can prolong an operational life of the sensor. As follows, this can lower costs for operating and maintaining the downhole tool.

The sensor container described herein can include one or a combination of one or more shock absorbers, one or more biasing assemblies, one or more bolted fasteners, and one or more Belleville washers to buffer forces applied to the sensor container, and subsequently the contained sensor, during operation of the downhole tool. Specifically, the sensor container can include one or a combination of one or more shock absorbers, one or more biasing assemblies, one or more bolted fasteners, and one or more Belleville washers to tune the sensor container's harmonic response to buffer forces applied to the sensor container during operation of the downhole tool. Further, structural shapes, materials, and other general design considerations of the sensor container, and the components included therein, can be selected to buffer forces applied to the sensor container during operation of the downhole tool. More specifically, structural shapes, materials, and other general design considerations of the sensor container, and the components included therein, can be selected to tune the sensor container's harmonic response to buffer forces applied to the sensor container during operation of the downhole tool.

Downhole tools are often exposed to a wide range of temperatures during operation. These wide temperature ranges can lead to the exertion of additional forces, apart from ambient downhole shock and vibration, on the downhole tool and components of the downhole tool during operation. The sensor container described herein can include one or a combination of one or more shock absorbers, one or more biasing assemblies, one or more bolted fasteners, and one or more Belleville washers to buffer forces applied to the sensor container and corresponding components as a result of the wide operational temperature ranges of the downhole tool. Further, structural shapes, materials, and other general design considerations of the sensor container, and the components included therein, can be selected to buffer forces applied to the sensor container and corresponding components as a result of these wide operational temperature ranges of the downhole tool.

Further, downhole tools utilize electronic components implemented on a PCB to control sensors for gathering measurements. As downhole tools have a number of different components with limited space, proper placement of the PCB in the downhole tool can be challenging. Specifically, a PCB is typically positioned as a separate component from a sensor and sensor container within the downhole tool, necessitating the use of long wires to connect the PCB to the sensor. However, the use of long wires to connect the PCB to the sensor can corrupt measurements made by the sensor. Specifically, measurements made by the sensor are susceptible to movement of the wires connecting the PCB to the sensor. The sensor container described herein can include a PCB integrated as part of the sensor container for controlling the sensor. This can decrease the length of wires used to connect the PCB to the sensor, thereby leading to more accurate sensor measurements.

Turning now to FIG. 1A, a drilling arrangement is shown that exemplifies a Logging While Drilling (commonly abbreviated as LWD) configuration in a wellbore drilling scenario 100. Logging-While-Drilling typically incorporates sensors that acquire formation data. The drilling arrangement of FIG. 1A also exemplifies what is referred to as Measurement While Drilling (commonly abbreviated as MWD) which utilizes sensors to acquire data from which the wellbore's path and position in three-dimensional space can be determined. FIG. 1A shows a drilling platform 102 equipped with a derrick 104 that supports a hoist 106 for raising and lowering a drill string 108. The hoist 106 suspends a top drive 110 suitable for rotating and lowering the drill string 108 through a well head 112. A drill bit 114 can be connected to the lower end of the drill string 108. As the drill bit 114 rotates, it creates a wellbore 116 that passes through various subterranean formations 118. A pump 120 circulates drilling fluid through a supply pipe 122 to top drive 110, down through the interior of drill string 108 and out orifices in drill bit 114 into the wellbore. The drilling fluid returns to the surface via the annulus around drill string 108, and into a retention pit 124. The drilling fluid transports cuttings from the wellbore 116 into the retention pit 124 and the drilling fluid's presence in the annulus aids in maintaining the integrity of the wellbore 116. Various materials can be used for drilling fluid, including oil-based fluids and water-based fluids.

Logging tools 126 can be integrated into the bottom-hole assembly 125 near the drill bit 114. As the drill bit 114 extends the wellbore 116 through the formations 118, logging tools 126 collect measurements relating to various formation properties as well as the orientation of the tool and various other drilling conditions. The bottom-hole assembly 125 may also include a telemetry sub 128 to transfer measurement data to a surface receiver 132 and to receive commands from the surface. In at least some cases, the telemetry sub 128 communicates with a surface receiver 132 using mud pulse telemetry. In some instances, the telemetry sub 128 does not communicate with the surface, but rather stores logging data for later retrieval at the surface when the logging assembly is recovered.

Each of the logging tools 126 may include one or more tool components spaced apart from each other and communicatively coupled by one or more wires and/or other communication arrangement. The logging tools 126 may also include one or more computing devices communicatively coupled with one or more of the tool components. The one or more computing devices may be configured to control or monitor a performance of the tool, process logging data, and/or carry out one or more aspects of the methods and processes of the present disclosure.

In at least some instances, one or more of the logging tools 126 may communicate with a surface receiver 132 by a wire, such as wired drill pipe. In other cases, the one or more of the logging tools 126 may communicate with a surface receiver 132 by wireless signal transmission. In at least some cases, one or more of the logging tools 126 may receive electrical power from a wire that extends to the surface, including wires extending through a wired drill pipe.

Collar 134 is a frequent component of a drill string 108 and generally resembles a very thick-walled cylindrical pipe, typically with threaded ends and a hollow core for the conveyance of drilling fluid. Multiple collars 134 can be included in the drill string 108 and are constructed and intended to be heavy to apply weight on the drill bit 114 to assist the drilling process. Because of the thickness of the collar's wall, pocket-type cutouts or other type recesses can be provided into the collar's wall without negatively impacting the integrity (strength, rigidity and the like) of the collar as a component of the drill string 108.

Figure 1B:
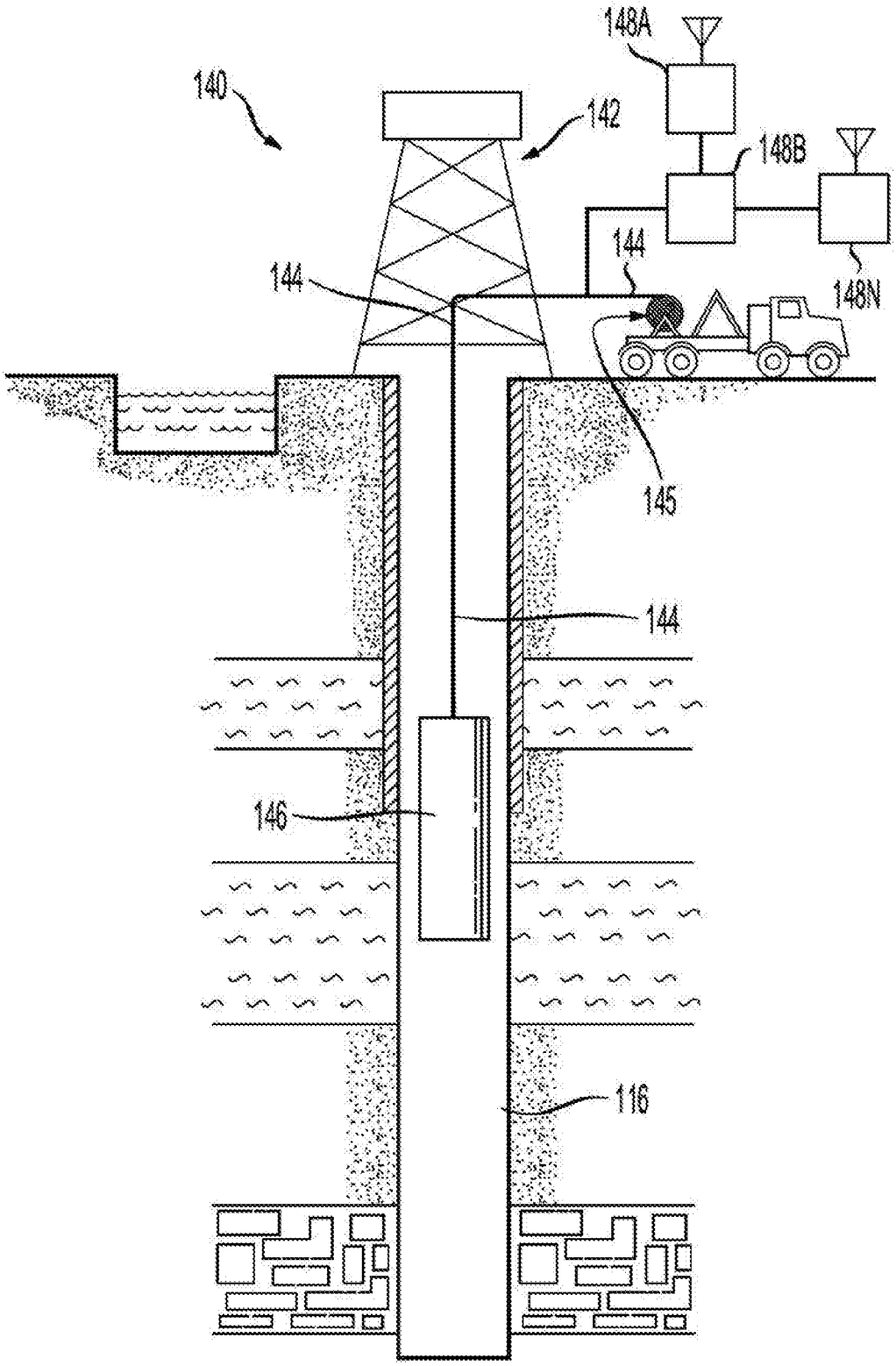
FIG. 1B is a schematic diagram of an example downhole environment having tubulars, in accordance with various aspects of the subject technology.

Referring to FIG. 1B, an example system 140 is depicted for conducting downhole measurements after at least a portion of a wellbore has been drilled and the drill string removed from the well. A downhole tool is shown having a tool body 146 in order to carry out logging and/or other operations. For example, instead of using the drill string 108 of FIG. 1A to lower tool body 146, which can contain sensors and/or other instrumentation for detecting and logging nearby characteristics and conditions of the wellbore 116 and surrounding formations, a wireline conveyance 144 can be used. The tool body 146 can be lowered into the wellbore 116 by wireline conveyance 144. The wireline conveyance 144 can be anchored in the drill rig 142 or by a portable means such as a truck 145. The wireline conveyance 144 can include one or more wires, slicklines, cables, and/or the like, as well as tubular conveyances such as coiled tubing, joint tubing, or other tubulars.

The illustrated wireline conveyance 144 provides power and support for the tool, as well as enabling communication between data processors 148A-N on the surface. In some examples, the wireline conveyance 144 can include electrical and/or fiber optic cabling for carrying out communications. The wireline conveyance 144 is sufficiently strong and flexible to tether the tool body 146 through the wellbore 116, while also permitting communication through the wireline conveyance 144 to one or more of the processors 148A-N, which can include local and/or remote processors. Moreover, power can be supplied via the wireline conveyance 144 to meet power requirements of the tool. For slickline or coiled tubing configurations, power can be supplied downhole with a battery or via a downhole generator.

Figure 2:
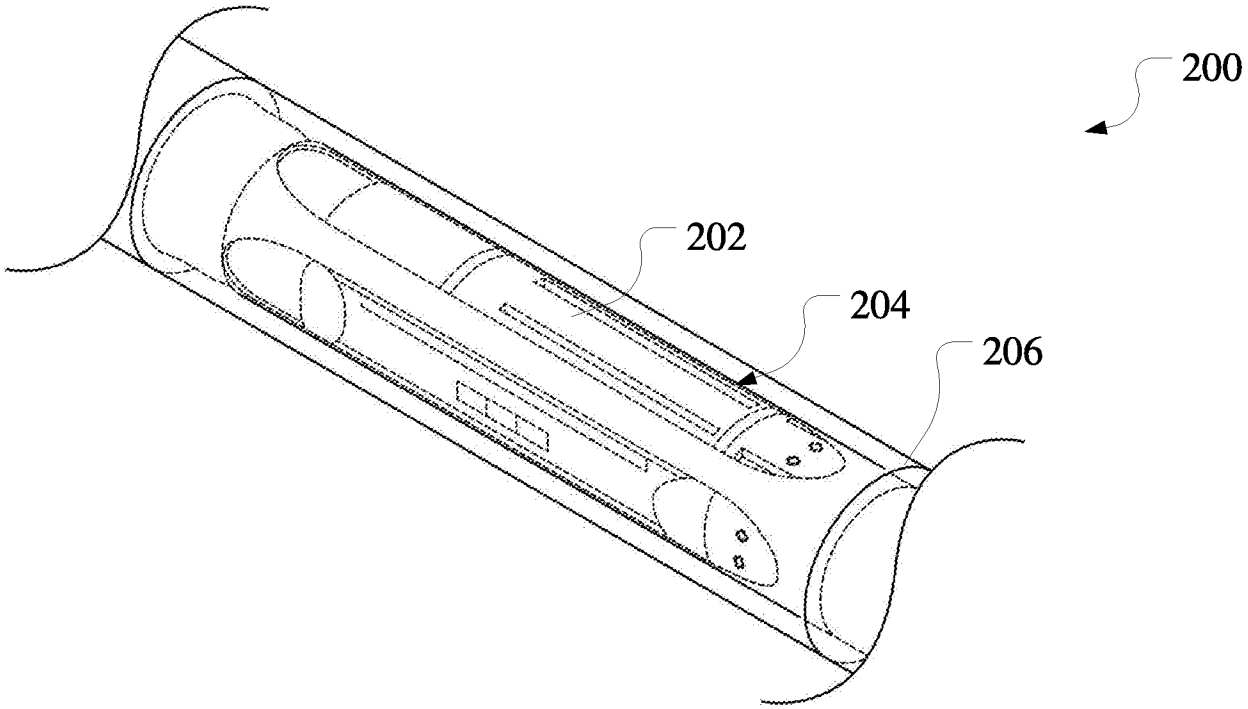
FIG. 2 is a schematic diagram of an example segment of a downhole tool, configured in accordance with various aspects of the subject technology.

FIG. 2 is a schematic diagram of an example segment of a downhole tool 200, configured in accordance with various aspects of the subject technology. The downhole tool 200 may be, for example, the bottom-hole assembly 125 of FIG. 1A, the tool body 146 of FIG. 1B, or any other object lowered into a wellbore that includes vibration and shock sensitive sensors. The portion of the downhole tool may be or include one of the logging tools 126 of FIG. 1A, a sensor collar, an electronics collar, a carrier, or any other portion of a downhole tool.

The segment of the downhole tool 200 includes a sensor container 202 contained, e.g. wholly, within a receiving space 204 of a carrier 206. The carrier 206 can be included as part of the downhole tool 200. Specifically, the carrier can be insertable, or otherwise form part of the downhole tool 200. For example, the carrier 206 can be a collar that is integrated as part of the downhole tool 200. Further, the carrier 206 can be configured to contain applicable components and modules of the downhole tool 200 utilized in operation of the downhole tool 200. Specifically, the carrier 206 can form, at least in part, one or a plurality of cavities, for containing different components and modules of the downhole tool 200, e.g. the sensor container 202. The carrier 206 can be of an applicable shape and design to form the receiving space 204 for receiving the sensor container 202. For example, the carrier 206 can include a hatch cover that forms, at least in part, the receiving space 204. The carrier 206 can be fabricated from an applicable material, e.g. steel.

The carrier 206 can be integrated with an inner layer. The inner layer can be contained within the carrier 206 between the carrier 206 and the sensor container 202. While the inner layer can be a separate component from the carrier 206, for purposes of this discussion, the inner layer is described as the inner layer of the carrier 206. The inner layer can be fabricated from an applicable material, e.g. steel. Together, the inner layer and the carrier 206 can combine to form a main tool body of the downhole tool 200. The inner layer of the carrier 206 can be in operational contact with the sensor container 202. Specifically, the sensor container 202 can be secured, e.g. rigidly secured, to the inner layer and/or the carrier 206. Accordingly, as the downhole tool 200 and carrier 206/inner layer move during operation of the downhole tool 200, the secured sensor container 202 can move with the downhole tool 200 and the carrier 206/inner layer. The inner layer can be fabricated from an applicable material, e.g. steel.

The sensor container 202 can be separate and removable from the downhole tool 200. Specifically, the sensor container 202 can be inserted into the carrier 206. Further, the carrier 206 can be insertable into the downhole tool 200. Accordingly, the sensor container 202 can be insertable into the downhole tool 200 and subsequently used during operation of the downhole tool 200. For example, the sensor container 202 can be shipped separate from the downhole tool 200 to a site, and subsequently inserted into the downhole tool 200 at the site for operation of the downhole tool 200. Further, the sensor container 202 can be removed from the downhole tool 200, e.g. after operation of the downhole tool 200. For example, the sensor container 202 can be removed from the downhole tool 200 for maintenance purposes.

The sensor container 202 is configured to contain a sensor, e.g. a fragile/shock-sensitive sensor. The sensor contained within the sensor container 202 can be an applicable sensor for gathering environmental measurements during operation of the downhole tool 200. Specifically, the sensor can be a gamma detector for gathering nuclear particles during operation of the downhole tool 200. The gamma detector can include a scintillation detector and a photomultiplier tube. The gathered nuclear particles can be used to measure characteristics of rock and material formations surrounding the downhole tool 200 or otherwise in proximity to the downhole tool 200. For example, the nuclear particles can be used to measure the connectivity of voids in rocks and material formations in proximity to the downhole tool 200 during operation of the downhole tool 200.

Figure 3:
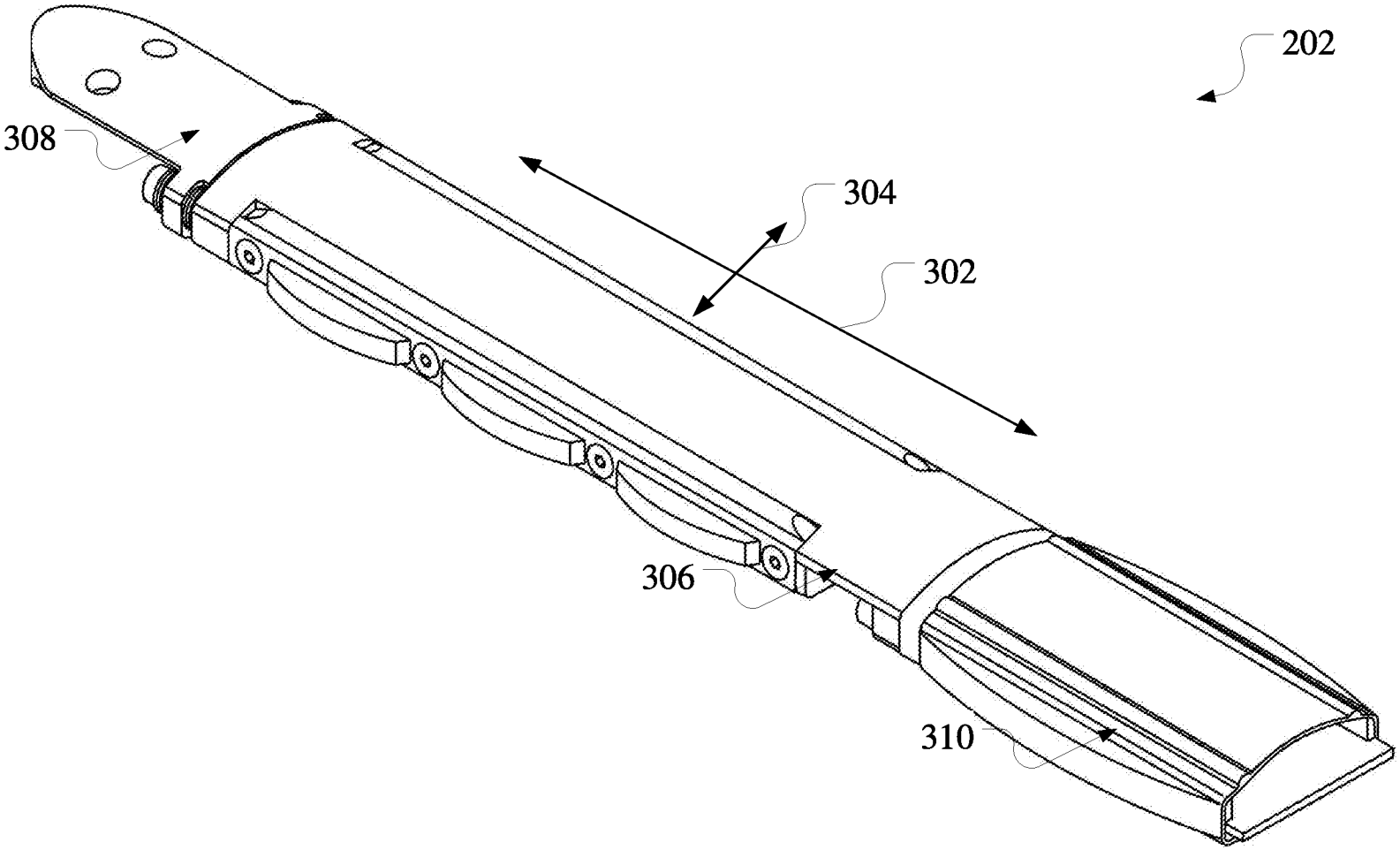
FIG. 3 is a perspective view of the sensor container, in accordance with various aspects of the subject technology.

FIG. 3 is a perspective view of the sensor container 202, in accordance with various aspects of the subject technology. The sensor container 202 is configured to receive the sensor. Specifically, the sensor container 202 can receive the sensor for mounting the sensor within the sensor container 202. In turn, when the sensor container 202 is incorporated within the downhole tool, e.g. through one or more couplings to the inner layer, the sensor can be contained within the downhole tool. As shown, in FIG. 3, the sensor container 202 can be elongate and have a lengthwise dimension greater than a widthwise dimension. A lengthwise dimension can include a dimension along an axial direction of the downhole tool and the corresponding sensor container 202 when the sensor container 202 is integrated within the downhole tool. A widthwise dimension can include a dimension along a cross-axial direction of the downhole tool and the corresponding sensor container 202 when the sensor container 202 is integrated within the downhole tool.

The sensor container 202 is also configured to buffer forces applied to the downhole tool during operation of the downhole tool. In buffering forces applied to the downhole tool during operation of the downhole tool, the forces can be transferred to the sensor container 202 through applicable components in contact with or coupled to the sensor container 202, when the sensor container 202 is integrated within the downhole tool. For example, the sensor container 202 can be in contact with the inner layer of the carrier that is inserted into the downhole tool to contain the sensor container 202 within the downhole tool. Further in the example, the sensor container 202 can buffer forces applied to the downhole tool that are transferred to the sensor container 202 through the inner layer and the carrier integrated as part of the downhole tool.

The sensor container 202 can buffer forces applied through operational and ambient downhole shock and vibration occurring during operation of the downhole tool. In particular and as will be discussed in greater detail below, a harmonic response of the sensor container 202 can be tuned, e.g. based on components and material characteristics of the components in the sensor container 202, to buffer forces applied to the downhole tool. Further and as will be discussed in greater detail below, the sensor container 202 can buffer or alleviate forces that would otherwise be induced within the contained sensor due to such things as thermal expansion. The sensor container 202 can buffer axial forces applied, e.g. along line 302, to the downhole tool. Axial forces can include forces applied along a longitudinal axis of the downhole tool, e.g. in a direction that the downhole tool travels during operation. Further, the sensor container 202 can buffer cross-axial forces applied, e.g. along line 304, to the downhole tool.

In buffering forces applied to the downhole tool, the sensor container 202 can affect forces applied to the sensor contained within the sensor container 202. Specifically, the sensor container 202 can buffer forces applied to the downhole tool to affect forces applied on the sensor from the forces applied to the downhole tool during operation of the downhole tool. In affecting forces applied to the sensor, the sensor container 202 can reduce the forces applied to the sensor. Specifically, the sensor container 202 can buffer the forces applied to the sensor when compared to forces that would be applied to the sensor if the sensor container 202 was not used, e.g. another container structure was used, to secure the sensor within the downhole tool. More specifically, the sensor container 202 can buffer the forces applied to the sensor from the overall forces applied to the downhole tool, and subsequently the sensor, during operation of the downhole tool.

The sensor container 202 includes a container body 306. As will be discussed in greater detail below, the container body 306 is configured to receive the sensor for securing the sensor within the sensor container 202. Specifically, the container body 306 can have a receiving space 400 to which the detector is couplable for containing the detector within the container body 306. In turn, the container body 306 can function, at least in part, to secure the sensor within the downhole tool through the sensor container 202.

Additionally, the sensor container 202 includes a biasing assembly 308. The biasing assembly 308 is configured to restrain axial movement, e.g. along line 302, of the contained sensor. Specifically, the biasing assembly 308 can exert a force directed lengthwise along the sensor container 202, e.g. along line 302. The biasing assembly 308 can exert a lengthwise force on an applicable component of the sensor container 202, e.g. the container body 306 and/or a contained sensor holder. In turn, the biasing assembly 308 can buffer axial forces applied to the downhole tool to buffer axial forces applied to the sensor contained within the container body 306, e.g. within a contained sensor holder. In buffering axial forces applied to the downhole tool, the biasing assembly 308 can physically contact the housing of the sensor, e.g. the container body 306, to buffer applied axial forces and subsequently buffer axial forces applied to the sensor.

The sensor container 202 also includes a PCB housing 310. The PCB housing 310 can receive a PCB that is wired to the sensor, e.g. as the sensor is contained within the container body 306. The PCB housing 310 can be secured to the container body 306 through an applicable securing mechanism, e.g. through bolts.

Further, the PCB housing 310 can be comprised, at least in part of a resilient material. For example, the PCB housing 310 can include a top shock absorber, side shock absorbers, bottom shock absorbers that are fabricated, at least in part, from a resilient material. A resilient material, as used herein, can include an applicable material capable of elastically deforming, e.g. rubber. The shock absorbers integrated as part of the PCB housing 310 can buffer forces, e.g. cross-axial forces, applied to the sensor container 202. For example, a rubber top contact of the PCB housing 310 can buffer cross-axial forces applied along the top and bottom of the PCB housing 310/sensor container 202.

While the PCB housing 310 and the container body 306 are shown as separate components in FIG. 3, in various embodiments, the PCB housing 310 and the container body 306 can be a single component, e.g. different portions of the same component. For example, the PCB housing 310 and the container body 306 can be formed from the same uni-body part/component.

As the PCB housing 310 is integrated as part of the sensor container 202 of the sensor container, the PCB housing 310 can contain the PCB within the sensor container. This is advantageous as it can shorten the length of wires between the PCB and the sensor, thereby improving measurements taken by the sensor. Specifically, both the PCB and the sensor can be contained within a single module, e.g. the sensor container, thereby reducing the length of wires between the sensor and the PCB.

The PCB housing 310 can also function to secure the sensor within the container body 306. For example, the PCB housing 310 can contact at least a portion of the sensor or a sensor holder containing the sensor to secure the sensor within the container body 306. Further in the example, the PCB housing 310 can prevent displacement of the sensor out of the container body 306, e.g. out of the receiving space 400 of the container body 306.

Figure 4:
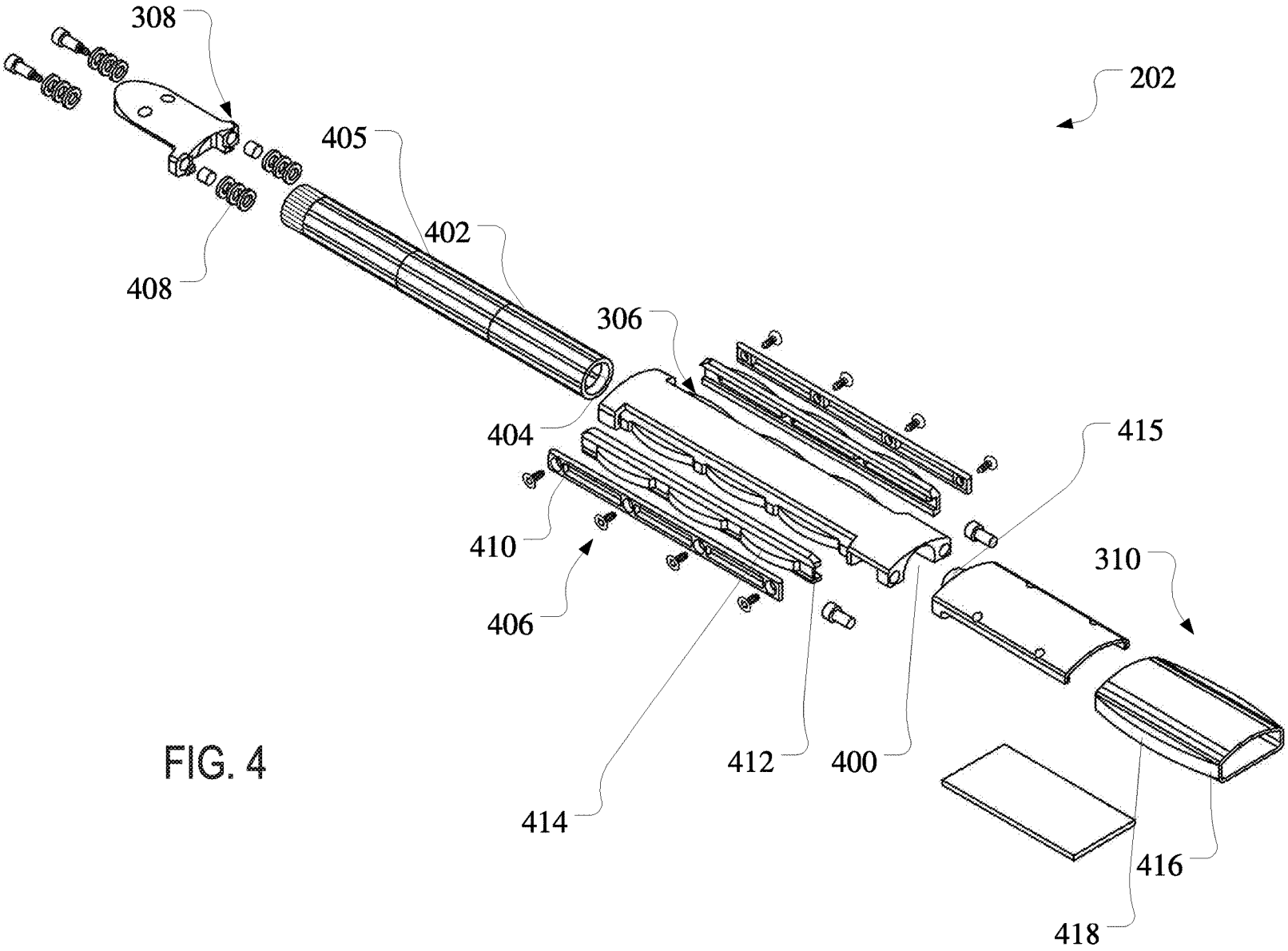
FIG. 4 is an exploded perspective view of the sensor container, in accordance with various aspects of the subject technology.

FIG. 4 is an exploded perspective view of the sensor container 202, in accordance with various aspects of the subject technology. The sensor container 202 includes a sensor holder 402 configured to create a cavity for receiving a sensor 404. A cavity of the sensor holder 402 can be shaped to secure the sensor 404 within the cavity. Further, the sensor holder 402 can be configured to buffer forces applied to the sensor 404 when contained in the sensor holder 402. Specifically, the sensor holder 402 can buffer forces transferred from the container body 306 to the sensor holder 402 when the sensor holder 402 is contained, at least in part, within the receiving space 400 of the container body 306.

The sensor holder 402 can be fabricated from a material or materials configured to buffer forces applied to the contained sensor 404. For example, the sensor holder 402 can be fabricated, at least in part, from a resilient material to buffer axial and cross-axial forces applied to the sensor container 202 thereby buffering forces applied to the contained sensor 404. The sensor holder 402 can be shaped to fit within a cavity/receiving space formed by the container body 306. Specifically, when the sensor holder 402 is fabricated from a resilient material, the sensor holder 402 can have an interference fit within the cavity formed by the container body 306.

The sensor holder 402, as shown in FIG. 4, can be substantially cylindrical shaped. In turn, when the sensor 404 is cylindrical shaped, the sensor 404 can fit within the sensor holder 402. The sensor holder 402 can also include one or more lengthwise orientated ribs 405. When the sensor holder 402 includes a plurality of ribs, the ribs can be spaced circumferentially about the sensor holder 402. The one or more ribs 405 can further influence buffering of forces. Specifically, the one or more ribs 405 are more pliable than the solid portions of the sensor holder 402, thereby further buffering forces transferred through the sensor container 202 and the container body 306.

The sensor container 202 includes one or more fasteners 406. The one or more fasteners 406 are configured to secure shock absorbers 412 to the container body 306, e.g. along one or more sides of the container body 306, and subsequently to the sensor container 202 of the sensor container 202. Specifically, the fasteners 406 can compress a securing plate 410 towards the container body 306 to secure the shock absorbers 412 disposed between the container body 306 and the securing plate 410 to the sensor container 202. Specifically, the shock absorbers 412 can be positioned on one or more lateral sides of the container body 306 and configured to buffer shock and vibration forces acting on the sensor container 202. In turn, the shock absorbers 412 can be releasably fastened along the lateral sides of the container body 306 using the securing plate 410 and the fasteners 406.

The shock absorbers 412 can each include a laterally exposed scalloped face. Specifically, the shock absorbers 412 include one or more protrusions 414 that extend out from the shock absorbers 412. Accordingly, when the shock absorbers 412 are secured to the sensor container 202, e.g. through the fasteners 406, the one or more protrusions 414 extend cross-axially out from the sensor container 202, e.g. along laterally exposed scalloped faces of the shock absorbers 412. The shock absorbers 412 can function to buffer forces, e.g. cross-axial forces, applied to the sensor container 202. Specifically and as will be described in greater detail below, the shock absorbers 412, e.g. through the one or more protrusions 414, can contact a portion of the inner layer of the carrier buffer forces applied to the sensor container 202 through the inner layer and the carrier when the carrier is integrated within the downhole tool. In turn, the shock absorbers 412 can buffer forces, e.g. cross-axial forces, applied to the contained sensor 404 during operation of the downhole tool.

The one or more protrusions 414 extending out from the shock absorbers 412 can be an applicable type of protrusion, e.g. a rib or a nub. One or a combination of a number, a shape, and a protrusion type of the one or more protrusions 414 extending out from the shock absorbers 412 can be selected based on a vibration response, e.g. of the downhole tool, to buffer forces applied to the downhole tool and subsequently the sensor container 202.

The biasing assembly 308 includes a plurality of compressible expansion members 408 for securing the biasing assembly 308 to either or both the sensor holder 402 and the container body 306. The compressible expansion members 408 can restrain movement of the sensor 404 and the corresponding sensor holder 402 along an axial direction of the downhole tool. Specifically, the compressible expansion members 408 can engage forces applied within or to the sensor holder 402 to restrain movement of the sensor holder 402 and the sensor 404 along the axial direction of the downhole tool. The compressible expansion members 408 can include an applicable biasing member, structure, and/or component for buffering forces applied along an axial direction of the downhole tool. For example, the compressible expansion members 408 can include Belleville washer(s) and/or coil spring(s). Specifically, the compressible expansion members 408 can include a plurality of Belleville washer stacks for buffering forces applied along an axial direction of the downhole tool. Specifically, the Belleville washer stacks can contact the sensor holder 402 to buffer forces applied along an axial direction of the downhole tool.

The PCB housing 310 can also prevent movement of the sensor 404. Specifically, the PCB housing 310 can be affixed to the container body to contact either or both the sensor holder 402 and the sensor 404 to prevent axial movement of the sensor 404 and the sensor holder 402. The PCB housing 310 can include an extended portion 415 that extends into the receiving space 400 of the container body 306 to contact either or both the sensor holder 402 and the sensor 404. In turn, the extended portion of the PCB housing 310 can prevent axial movement of the sensor 404 and the sensor holder 402.

The portion 415 of the PCB housing 310 that extends into the sensor holder 402 can be threaded to receive the sensor 404. In turn, the sensor 404 can also be threaded to fit securely to the PCB housing 310. Accordingly, the PCB housing 310 can be secured to the sensor 404 and the sensor holder 402 through the threading.

The PCB housing 310 also includes shock absorbers 416 disposed along one or more sides of the PCB housing 310. The shock absorbers 416 of the PCB housing 310 can extend cross-axially out from the PCB housing 310 along lateral sides of the PCB housing 310. The shock absorbers 416 can be fabricated, at least in part, from a resilient material.

The shock absorbers 416 can include laterally exposed scalloped faces. Specifically, the shock absorbers 416 include one or more protrusions 418, e.g. resilient material protrusions, that extend cross-axially out from the PCB housing 310 and subsequently the sensor container 202 when the PCB housing 310 is integrated as part of the sensor container 202. The shock absorbers 416 can function to buffer forces, e.g. cross-axial forces, applied to the sensor container 202. Specifically, the shock absorbers 416, e.g. the one or more protrusions 418, can contact the inner layer of the carrier to buffer forces applied to the sensor container 202 through the carrier of the downhole tool. In turn, the shock absorbers 416 can buffer forces, e.g. cross-axial forces, applied to the contained sensor 404 during operation of the downhole tool.

The one or more protrusions 418 extending out from the shock absorbers 416 can be an applicable type of protrusion, e.g. a rib or a nub. One or a combination of a number, a shape, and a protrusion type of the one or more protrusions 418 extending out from the shock absorbers 416 can be selected based on a vibration response, e.g. of the downhole tool, to buffer forces applied to the downhole tool and subsequently the sensor container 202.

Figure 5:
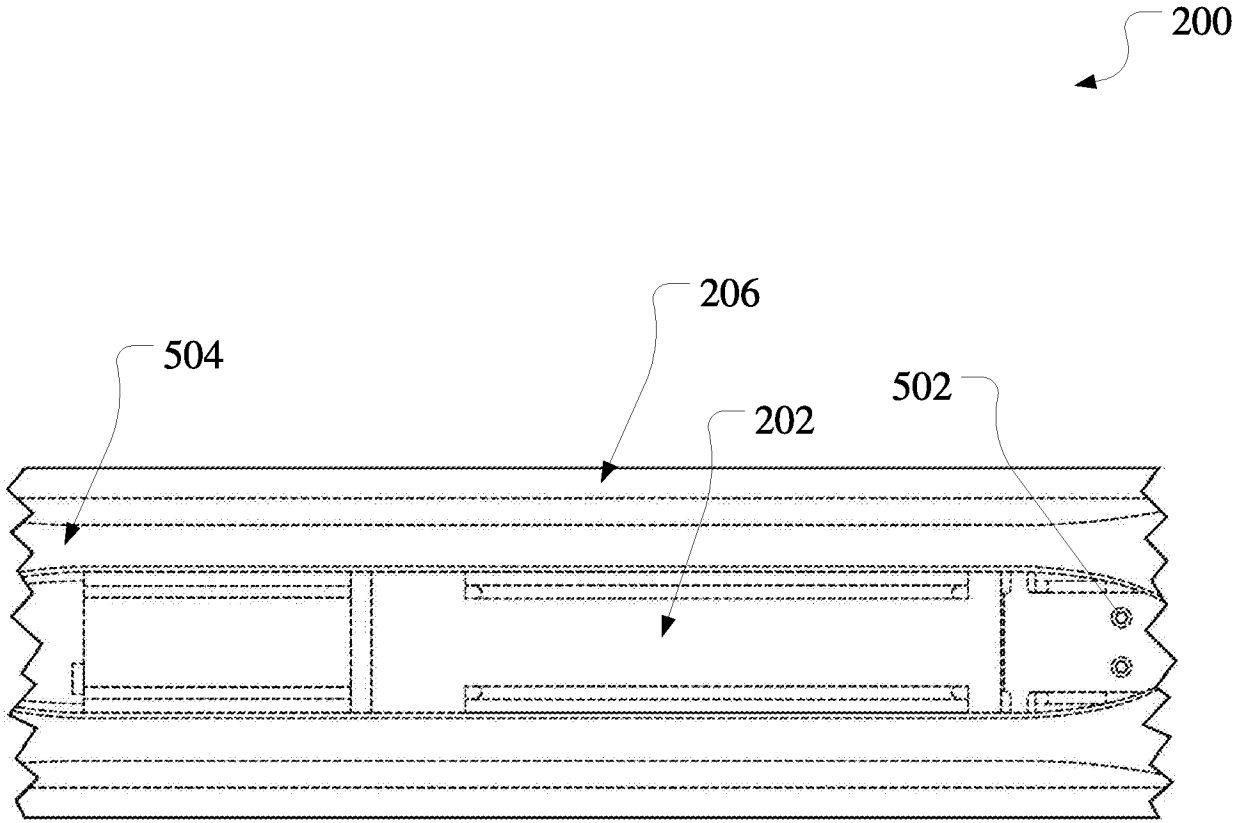
FIG. 5 is a top view of the sensor container within a portion of the downhole tool, in accordance with various aspects of the subject technology.

FIG. 5 is a cross-sectional perspective view of the sensor container 202 within a portion of the downhole tool 200, in accordance with various aspects of the subject technology. The sensor container 202 includes mounting fasteners 502 for securing the sensor container 202 to the carrier 206 within the downhole tool. Specifically, the mounting fasteners 502 can secure the sensor container 202 to the carrier 206 of the downhole tool 200 through the inner layer 504. The mounting fasteners 502 can be screws that are configured to extend through the sensor container 202, the inner layer 504, and potentially at least a portion of the carrier 206, to secure the sensor container 202 within the carrier 206.

The mounting fasteners 502 can be positioned at a single end of the sensor container 202, thereby rigidly securing the sensor container 202 to the inner layer 504, and subsequently the carrier 206, at only the single end. In only being rigidly secured to the carrier 206 at a single end, the sensor container 202 can still move, e.g. cross-axially, within the carrier 206. Specifically, the sensor container 202 can still move within the carrier 206 to account for differences in thermal expansion between materials of the sensor container 202, the carrier 206, and the inner layer 504 of the carrier 206.

As shown in FIG. 5, the inner layer 504 is disposed between the sensor container 202 and the carrier 206. The inner layer 504 can be shaped to contact both the carrier 206 and the sensor container 202. In turn, the inner layer 504 can transfer forces applied to the downhole tool from the carrier 206 to the sensor container 202. As discussed herein, components of the sensor container 202 can be disposed between the components of the sensor container 202, e.g. the container body 306, and the inner layer 504. These components can be configured to buffer forces applied to the downhole tool 200 through the inner layer 504 and the carrier 206. In turn, these components can buffer forces applied to the sensor container 202. For example, these components can resist cross-axial forces transferred through or created by the inner layer 504 and the carrier 206 to buffer cross-axial forces applied to the sensor container 202 during operation of the downhole tool 200.

Figure 6:
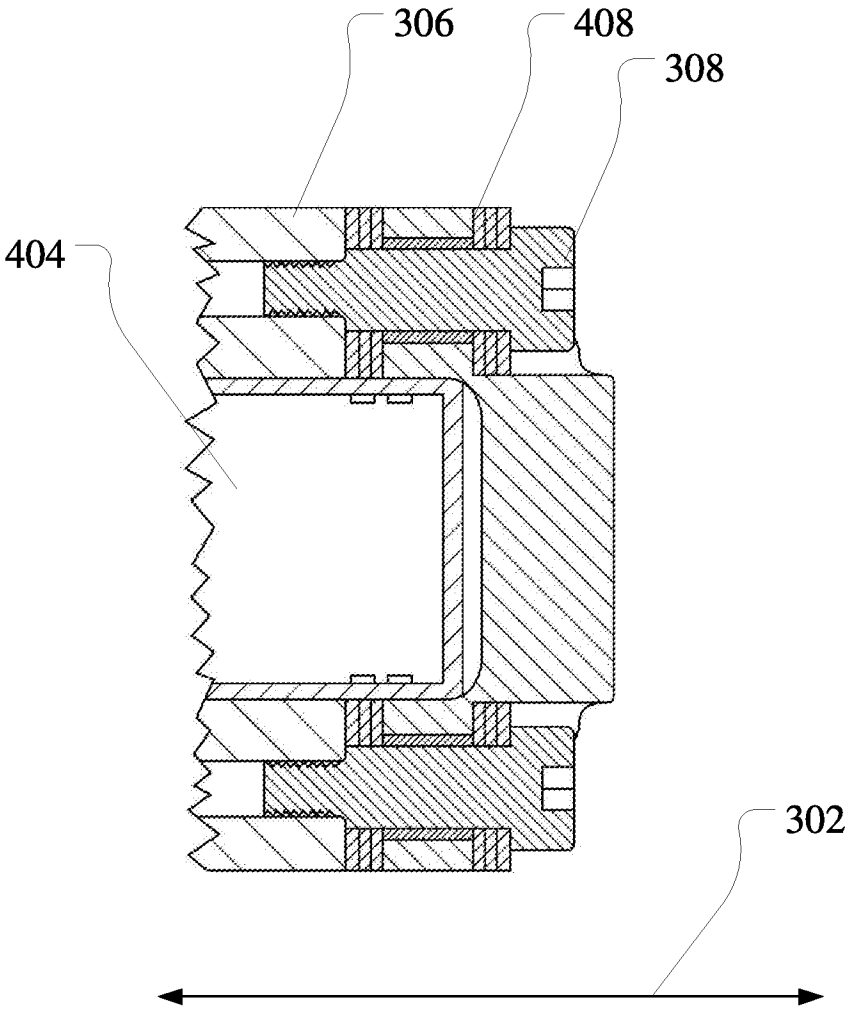
FIG. 6 is a cross-sectional view of the biasing assembly in operational contact with the container body of the sensor container, in accordance with various aspects of the subject technology.

FIG. 6 is a cross-sectional view of the biasing assembly 308 in operational contact with the container body 306 of the sensor container, in accordance with various aspects of the subject technology. The biasing assembly 308 contacts the container body 306 through the compressible expansion members 408. The compressible expansion members 408 can function to exert a force opposite of applied forces, thereby buffering applied forces, e.g. applied axial forces, on the sensor 404. Specifically, the compressible expansion members 408 can absorb axial forces applied to the downhole tool and transferred to the sensor container through the carrier and the inner layer to restrain movement of the container body 306 and the sensor holder contained within. In turn, this can buffer axial forces applied to the sensor 404 contained within the container body 306. The shock absorbing structures 600 can comprise a plurality of screws and Belleville washers disposed along an axial direction of the downhole tool.

Figure 7:
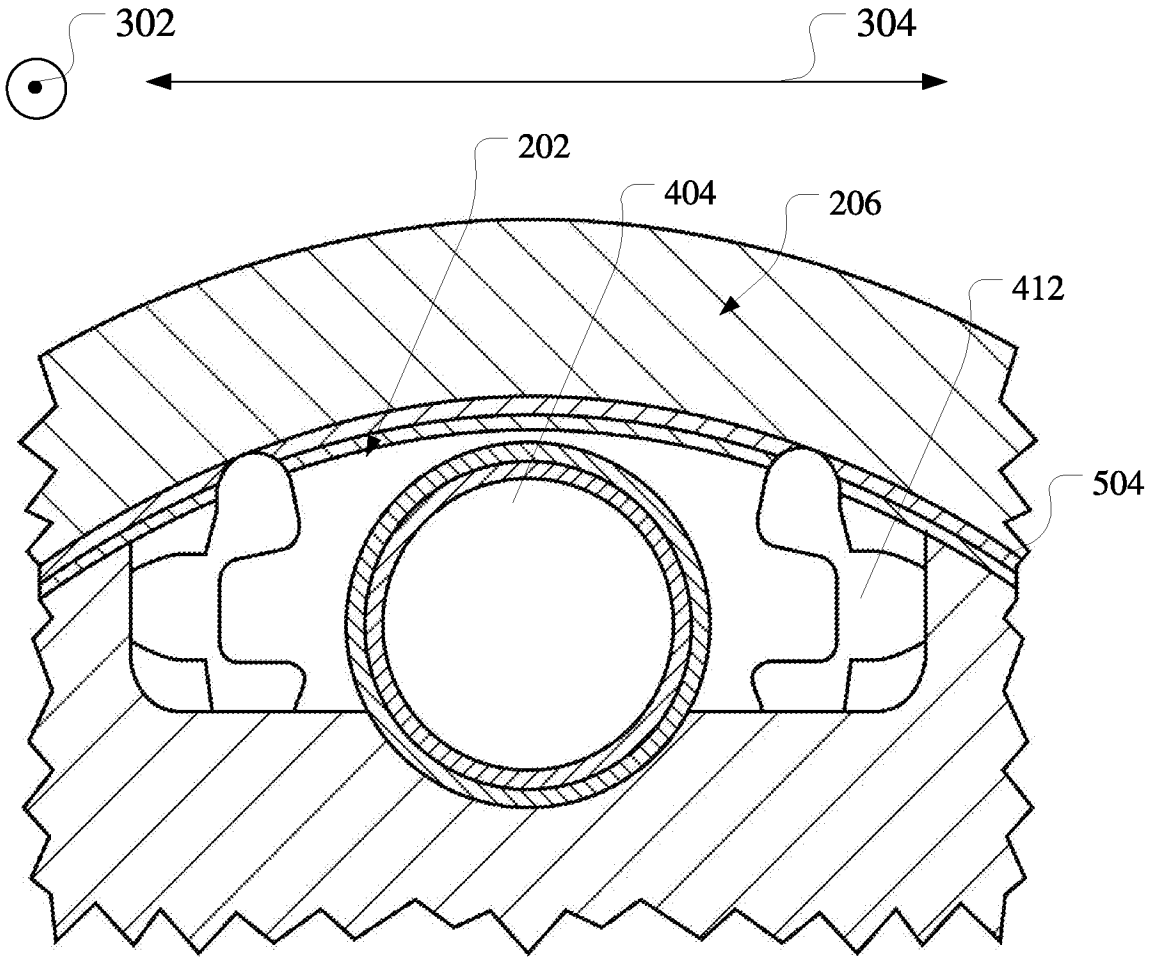
FIG. 7 is a cross-sectional view of the sensor container in operational contact with the inner layer and the carrier, in accordance with various aspects of the subject technology.

FIG. 7 is a cross-sectional view of the sensor container 202 in operational contact with the inner layer 504 and the carrier 206, in accordance with various aspects of the subject technology. The sensor container 202 is in contact with the inner layer 504 through the shock absorbers 412. The shock absorbers 412 can be shaped to fit along at least a portion of the sensor container 202. Specifically and as discussed above, the shock absorbers 412 can fit along the sides of the sensor container 202. In being positioned along the sides of the sensor container 202, the shock absorbers 412 can buffer cross-axial forces applied to the sensor container 202 and the sensor 404 contained within the sensor container 202. Specifically, the shock absorbers 412 can buffer cross-axial forces applied to the sensor container 202 and the sensor 404 through the carrier 206 and the inner layer 504.

Either or both of a size and material(s) of construction of the shock absorbers 412 can be selected based on a range of operational temperatures of the downhole tool 200. In particular, the size and the materials of the shock absorbers 412 can be selected to account for varying physical characteristics of the carrier 206, the inner layer 504, and/or the sensor container 202. For example, the container body of the sensor container 202 and either or both the carrier 206 and the inner layer 504 can be fabricated from different materials and therefore expand differently under high temperatures. As follows, shock absorbers 412 can be fabricated from a resilient material to account for these differences in thermal expansion and displace as the container body, the inner layer 504, and/or the carrier 206 expand differently under various temperatures, e.g. high temperatures.

In various embodiments, the sensor container, as described herein, can be fabricated based on characteristics of the downhole tool and characteristics of the sensor contained within the sensor container. Characteristics of the downhole tool can include applicable characteristics of the downhole tool pertaining to operation of the downhole tool. For example, characteristics of the downhole tool can include dimensions of the carrier inserted into the downhole tool. Characteristics of the sensor can include applicable characteristics of the sensor, e.g. characteristics pertaining to operation of the sensor in the downhole tool. For example, characteristics of the sensor can include a shape of the sensor.

In fabricating the sensor container according to characteristics of the downhole tool and the sensor, applicable components of the sensor container can be fabricated according to the characteristics of the downhole tool and the sensor. Specifically, the container body can be fabricated according to the characteristics of the downhole tool and the sensor. More specifically, the container body can be shaped to form a suitably sized cavity for receiving the sensor. Further, the mechanical mounting structure can be shaped to fit within a receiving space of the carrier.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrative embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1. A sensor container for a downhole sensor mountable in a receiving space on a carrier that is insertable into a wellbore. The sensor container can comprise a container body having a receiving space to which a shock-sensitive sensor is couplable. The sensor container can also comprise a shock absorber positioned at a lateral side thereof and configured to buffer shock forces and vibration forces acting thereupon.

Statement 2. The sensor container of statement 1, wherein the sensor container is elongate and has a lengthwise dimension greater than a widthwise dimension thereof.

Statement 3. The sensor container of statements 1 or 2, further comprising a biasing assembly that exerts a force directed lengthwise within the sensor container.

Statement 4. The sensor container of statements 1 through 3, further comprising a sensor holder configured to fit at least partially into the receiving space of the container body.

Statement 5. The sensor container of statements 1 through 4, wherein the sensor holder is substantially cylindrical shaped and at least partially constructed from resilient material.

Statement 6. The sensor container of statements 1 through 5, further comprising a sensor located predominantly within the sensor holder.

Statement 7. The sensor container of statements 1 through 6, wherein the substantially cylindrical shaped sensor holder has lengthwise oriented ribs spaced circumferentially about the sensor holder.

Statement 8. The sensor container of statements 1 through 7, further comprising a gamma sensor housed within the sensor holder.

Statement 9. The sensor container of statements 1 through 8, further comprising a shock absorber positioned at each of two lateral sides of the sensor container and each shock absorber configured to buffer shock forces and vibration forces acting respectively thereupon.

Statement 10. The sensor container of statements 1 through 9, wherein each shock absorber has a laterally exposed scalloped face.

Statement 11. The sensor container of statements 1 through 10, wherein each shock absorber is constructed from resilient material and releasably fastened to a lateral side of the sensor container.

Statement 12. The sensor container of statements 1 through 11, wherein the sensor container is elongate and has a lengthwise dimension greater than a widthwise dimension thereof and the sensor container further comprises a biasing assembly that exerts a force directed lengthwise within the sensor container. The biasing assembly can further comprise a compressible expansion member.

Statement 13. The sensor container of statements 1 through 12, wherein the compressible expansion member is at least one Belleville washer.

Statement 14. The sensor container of statements 1 through 13, further comprising a printed circuit board housing integrated as part of the container body for receiving a printed circuit board within the printed circuit board housing.

Statement 15. A downhole tool comprising a drilling assembly and a sensor container mounted in a receiving space of a carrier portion of the downhole tool. The sensor container can comprise a container body having a receiving space in which a shock-sensitive sensor is coupled. The sensor container can also comprise a shock absorber positioned at a lateral side of the sensor container and configured to buffer shock forces and vibration forces that act thereupon.

Statement 16. The downhole tool of statement 15, wherein the sensor container further comprises a biasing assembly exerting a force directed lengthwise within the sensor container.

Statement 17. The downhole tool of statements 15 and 16, wherein the sensor container further comprises a sensor holder frictionally fit at least partially in the receiving space of the container body.

Statement 18. The downhole tool of statements 15 through 17, wherein the sensor container further comprises a shock absorber positioned at each of two lateral sides of the sensor container and each shock absorber buffers shock forces and vibration forces acting respectively thereupon, and each shock absorber having a laterally exposed scalloped face.

Statement 19. The downhole tool of statements 15 through 18, wherein the sensor container further comprises a printed circuit board housing integrated as part of the container body and in which a printed circuit board is received.

Statement 20. A method of fabricating a sensor container for a downhole tool comprising identifying characteristics of the downhole tool and characteristics of a shock-sensitive sensor configured to gather environmental measurements of the downhole tool during operation of the downhole tool. The method can also include fabricating a container body of the sensor container based on the characteristics of shock-sensitive sensor and the characteristics of the downhole tool, the container body having a receiving space to which the shock-sensitive sensor is couplable. Further, the method can include a container body of the sensor container based on the characteristics of shock-sensitive sensor and the characteristics of the downhole tool, the container body having a receiving space to which the shock-sensitive sensor is couplable; and configured to buffer shock forces and vibration forces acting thereupon.

What is claimed is:

1. A sensor container for a downhole sensor mountable in a receiving space on a carrier that is insertable into a wellbore, the sensor container comprising:

a container body having a receiving space to which a shock-sensitive sensor is couplable, wherein a printed circuit board housing is integrated as part of the container body for receiving a printed circuit board such that the printed circuit board is within the container body, wherein the printed circuit board is connected to the shock-sensitive sensor via wires that traverse from the printed circuit board through the printed circuit board housing to the shock-sensitive sensor outside of the printed circuit board housing, wherein the printed circuit board housing contacts at least a portion of the shock-sensitive sensor; and a shock absorber positioned at a lateral side thereof and configured to buffer shock forces and vibration forces acting thereupon.

2. The sensor container of claim 1, wherein the sensor container is elongate and has a lengthwise dimension greater than a widthwise dimension thereof.

3. The sensor container of claim 2, further comprising a biasing assembly that exerts a force directed lengthwise within the sensor container.

4. The sensor container of claim 2, further comprising a sensor holder configured to fit at least partially into the receiving space of the container body.

5. The sensor container of claim 4, wherein the sensor holder is substantially cylindrical shaped and at least partially constructed from resilient material.

6. The sensor container of claim 5, further comprising a sensor located predominantly within the sensor holder.

7. The sensor container of claim 5, wherein the substantially cylindrical shaped sensor holder has lengthwise oriented ribs spaced circumferentially about the sensor holder.

8. The sensor container of claim 5, further comprising a gamma sensor housed within the sensor holder.

9. The sensor container of claim 1, wherein the shock absorber is positioned at each of two lateral sides of the sensor container and each shock absorber configured to buffer shock forces and vibration forces acting respectively thereupon.

10. The sensor container of claim 1, wherein each shock absorber has a laterally exposed scalloped face.

11. The sensor container of claim 1, wherein each shock absorber is constructed from resilient material and releasably fastened to a lateral side of the sensor container.

12. The sensor container of claim 1, further comprising:

the sensor container being elongate and having a lengthwise dimension greater than a widthwise dimension thereof and the sensor container further comprising a biasing assembly that exerts a force directed lengthwise within the sensor container; and the biasing assembly comprising a compressible expansion member.

13. The sensor container of claim 12, wherein the compressible expansion member is at least one Belleville washer.

14. A downhole tool comprising:

a drilling assembly;

a sensor container mounted in a receiving space of a carrier portion of the downhole tool, the sensor container comprising:

a container body having a receiving space in which a shock-sensitive sensor is coupled, wherein a printed circuit board housing is integrated as part of the container body for receiving a printed circuit board such that the printed circuit board is within the container body, wherein the printed circuit board is connected to the shock-sensitive sensor via wires that traverse from the printed circuit board through the printed circuit board housing to the shock-sensitive sensor outside of the printed circuit board housing, wherein the printed circuit board housing contacts at least a portion of the shock-sensitive sensor; and a shock absorber positioned at a lateral side of the sensor container and configured to buffer shock forces and vibration forces that act thereupon.

15. The downhole tool of claim 14, wherein the sensor container further comprises a biasing assembly exerting a force directed lengthwise within the sensor container.

16. The downhole tool of claim 14, wherein the sensor container further comprises a sensor holder frictionally fit at least partially in the receiving space of the container body.

17. The downhole tool of claim 14, wherein the sensor container further comprises a shock absorber positioned at each of two lateral sides of the sensor container and each shock absorber buffers shock forces and vibration forces acting respectively thereupon, and each shock absorber having a laterally exposed scalloped face.

18. A method for fabricating a sensor container for a downhole tool comprising:

identifying characteristics of the downhole tool and characteristics of a shock-sensitive sensor configured to gather environmental measurements of the downhole tool during operation of the downhole tool;

fabricating a container body of the sensor container based on the characteristics of the shock-sensitive sensor and the characteristics of the downhole tool, the container body having a receiving space to which the shock-sensitive sensor is couplable, wherein a printed circuit board housing is integrated as part of the container body for receiving a printed circuit board such that the printed circuit board is within the container body, wherein the printed circuit board is connected to the shock-sensitive sensor via wires that traverse from the printed circuit board through the printed circuit board housing to the shock-sensitive sensor outside of the printed circuit board housing, wherein the printed circuit board housing contacts at least a portion of the shock-sensitive sensor; and fabricating a shock absorber of the sensor container based on the characteristics of the shock-sensitive sensor and the characteristics of the downhole tool, wherein the shock absorber is positionable at a lateral side of the container body and configured to buffer shock forces and vibration forces acting thereupon.

* * * * *